United States Patent [19]

Quemore, Sr.

[11] 4,249,450

[45] Feb. 10, 1981

[54] GUITAR AND CHORD PLAYING ATTACHMENT PIVOTALLY MOUNTED THEREON

[76] Inventor: William J. Quemore, Sr., 149 E. Church Rd., Blackwood, N.J. 08012

[21] Appl. No.: 50,646

[22] Filed: Jun. 21, 1979

[51] Int. Cl.[3] ..... G10D 3/04

[52] U.S. Cl. ..... 84/317; 84/167; 84/314 R; 84/318; 84/422 S

[58] Field of Search ..... 84/315-319

[56] References Cited

U.S. PATENT DOCUMENTS

| | | | |
|---|---|---|---|
| 1,518,719 | 12/1924 | Whiteman | 84/318 |
| 2,195,521 | 4/1940 | Rebsamen | 84/319 |
| 3,396,622 | 8/1968 | Johnston | 84/318 |
| 3,568,560 | 3/1971 | Chang et al. | 84/317 |

*Primary Examiner*—Lawrence R. Franklin
*Attorney, Agent, or Firm*—Morton C. Jacobs

[57] ABSTRACT

A guitar having four strings, two frets and an attachment pivotally mounted between the frets whereby the three principal chords of any key to which it has been tuned may be obtained clearly.

4 Claims, 8 Drawing Figures

GUITAR AND CHORD PLAYING ATTACHMENT PIVOTALLY MOUNTED THEREON

BACKGROUND OF THE INVENTION

This invention relates to a simplified folk guitar having a pivotally mounted chord playing attachment enabling handicapped elderly persons or children to play chords. The conventional folk guitar of six strings and eighteen frets on the fingering board requires considerable dexterity, finger length and strength to play the various chord combinations to accompany vocal music.

It is therefore a principal object of this invention to provide a new and improved guitar and chord playing attachment.

Another object of this invention is to provide a chord playing attachment which will produce clear sounding chords.

A further object of this invention is to provide a chord playing attachment for a guitar which may be easily manipulated by handicapped persons or the young.

A still further object of this invention is to provide a guitar which will be more economic to manufacture than the conventional folk guitar.

BRIEF DESCRIPTION OF THE DRAWINGS

These and other objects and advantages of the invention will subsequently become apparent from the following detailed description when read in conjunction with the accompanying drawings wherein.

DETAILED DESCRIPTION OF THE INVENTION AND DRAWINGS

Figure 1:
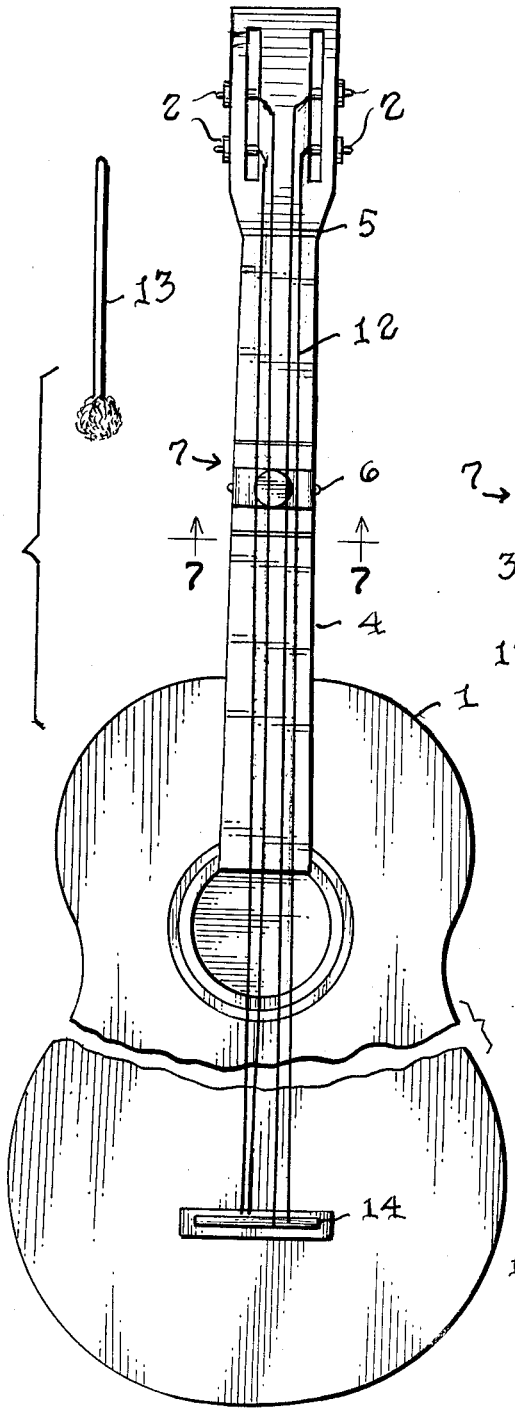
FIG. 1 is a front elevation view of the guitar and chord playing attachment.
Figure 2:
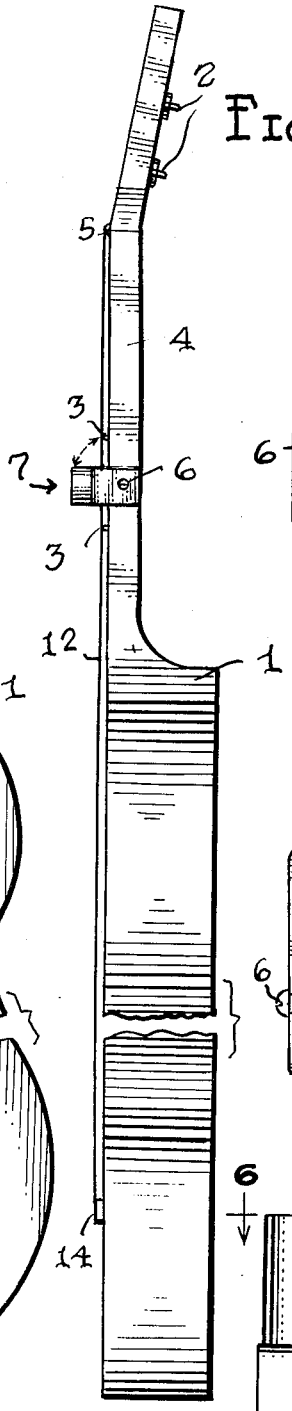
FIG. 2 is a side elevation view of the guitar.

Guitar 1 as shown in FIGS. 1 and 2 is a modified folk guitar having only four strings 12 as indicated by the four tuning pegs 2. The lower E and A strings of the usual six string guitar have been omitted leaving the D, G, B and E strings to be used in the guitar of the invention. Another significant difference from the conventional guitar is the use of only two frets 3 on the finger board 4. These are located at what would normally be the fifth and seventh frets from nut 5.

Figure 8:
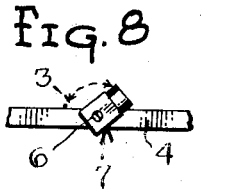
FIG. 8 is a fragmentary part showing the attachment in a pivoting position.
Figure 3:
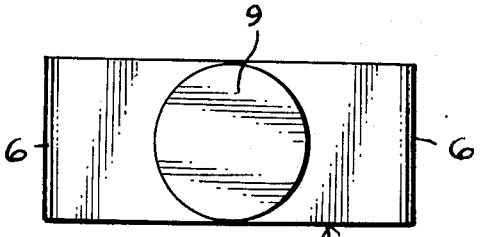
FIG. 3 is a top plan view of the chord playing attachment.
Figure 4:
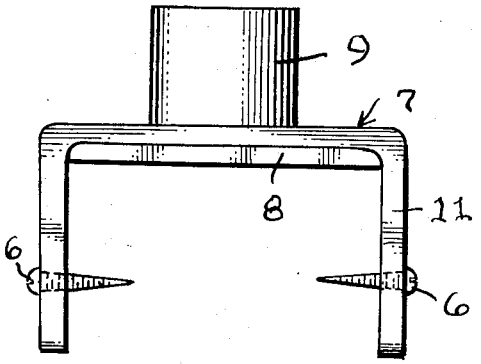
FIG. 4 is a front elevation view of the chord playing attachment.
Figure 5:
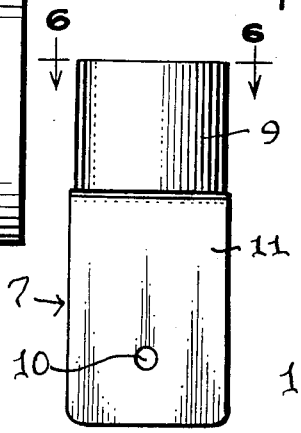
FIG. 5 is a side elevation view of the chord playing attachment.
Figure 6:
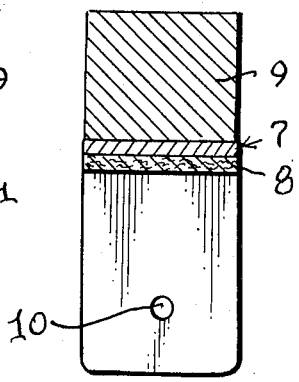
FIG. 6 is a sectional view taken along lines 6—6 in FIG. 5.
Figure 7:
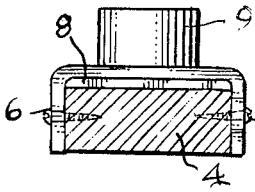
FIG. 7 is an enlarged sectional view taken along lines 7—7 of FIG. 1.

Pivotally mounted between the frets by screws 6 is the chord playing attachment 7. The generally U-shaped structure as shown in FIGS. 4 and 7 may be made of wood, pressed paper or plastic. Laminated across the inner surface of the bridging portion is a soft leather sheet 8. Secured to the top is a knob 9. The attachment is secured to the guitar by the screws 6 passing through holes 10 in the wing portions 11. As shown in FIGS. 3 and 8 the attachment may be grasped by the hand and pivoted to press the strings evenly against either of the two frets to provide clear, unfuzzy chord tones when strummed.

The guitar of the invention is of particular advantage to children wishing to learn to play and elderly people who may have arthritis and are incapable of fingering the strings against the fingerboard. By just recognizing three notes on the treble clef staff i.e. C, the G above the staff and D below the staff, the three principal chords of any key may quickly be learned to be played. For example, if the strings are tuned to the commonly used key of G and the attachment is in the neutral or upright position as shown in FIGS. 1 and 2, the strings when strummed will produce the G chord as indicated by the musical notation G. Pivoting the attachment upwardly to contact the strings against the fret as shown in FIG. 2 will produce the C chord indicated by the notation C on the written music. The D-7 chord is produced by pivoting the attachment downwardly against the other fret, indicated by the notation D.

Using the same notation the three principal chords of other keys may be similarly played. Thus if the strings are tuned to the key of C, the notation G would indicate the neutral position and open strings would produce the C chord. The notation C would indicate pivoting the attachment to the upper fret which would produce the F chord while the notation D indicating a downward pivoting would produce the G-7 chord. The same relationship would accrue in the other popular keys of D, F and B flat used in folk guitar music.

The strings of the guitar may be strummed by fingers, pick or a felted stick 13 used in marimba playing. The guitar itself may be held in various ways according to the capabilities of the player. Thus it may be kept horizontally in its case, held vertically upright between the knees while sitting, held horizontally on the lap or in the conventional guitar position with or without a strap. The strings can terminate at bridge 14.

The economy in the construction of the guitar is readily apparent. While the preferred construction and materials have been shown and described herein, other changes in the details may be made, but it is to be understood that such changes will be made within the spirit and scope of the present invention; for example, attachment 7 may be used on a conventional guitar:

I claim:

1. A guitar comprising:

a sound box;

an elongated fingerboard extending from said sound box and having two spaced frets for sounding different chords;

means for stretching a plurality of strings along said fingerboard and over said sound box and for engagement with said two frets;

and a chord playing attachment to enable persons with limited skills to play a narrow repertoire of chords, said attachment including:

a fret and string engaging member, means for pivotally securing said fret and string engaging member to the sides of said fingerboard and between said frets to enable the sounding of a plurality of chords, said fret and string engaging member being shorter than the space between said two frets and of width approximately equal to that of said frets, said pivotal means including means to locate surfaces of said fret and string engaging member to engage said two frets and said strings thereagainst in respectively two extreme pivotal positions, and to be spaced from said frets and strings in a third intermediate pivotal position, and means for manipulating said fret and string engaging member so that handicapped and unskilled persons can sound three chords by pivoting said fret and string engaging member to said three positions.

2. A guitar as recited in claim 1 wherein said chord playing attachment includes a U-shaped member, said fret and string engaging member includes a yielding surface on the bridging portion of said U-shaped member, said pivot means includes the two spaced wing portions of said U-shaped member and pivot elements for pivotally securing said wing portions to opposite sides of said fingerboard.

3. A guitar as recited in claim 1 wherein said yielding surface includes leather bonded to the undersurface of said bridging portion of said U-shaped member, and a handle projecting from the top surface of said bridging portion.

4. A guitar as recited in claim 1 having only said two frets on said fingerboard, in combination with a felted stick for vibrating said strings and sounding said chords.

* * * * *